US005832859A

United States Patent [19]

Sawyer et al.

[11] Patent Number: 5,832,859

[45] Date of Patent: Nov. 10, 1998

[54] WELDED STUD HANGING ASSEMBLY FOR A BLASTING AND COATING CONTAINMENT SYSTEM

[75] Inventors: David R. Sawyer, Smithfield; Bennie C. Steele, Newport News, both of Va.

[73] Assignee: Newport News Shipbuilding and Dry Dock Company, Newport News, Va.

[21] Appl. No.: 587,552

[22] Filed: Jan. 17, 1996

[51] Int. Cl.[6] ..... B63B 59/06

[52] U.S. Cl. ..... 114/222; 405/4

[58] Field of Search ..... 114/221 R, 222, 114/361, 229, 45, 65 R; 160/45, 333, 339; 135/90, 117, 120.4, 901; 405/4, 5

[56] References Cited

U.S. PATENT DOCUMENTS 5,211,125 5/1993 Garland et al. ..... 114/222

FOREIGN PATENT DOCUMENTS 1449450 1/1989 U.S.S.R. ..... 405/4

*Primary Examiner*—Sherman Basinger
*Attorney, Agent, or Firm*—Lalos & Keegan

[57] ABSTRACT

A method and apparatus for containment of a space adjacent the hull of a ship to protect the environment from polluting materials resulting from the abrasive blasting, spray painting and the like comprising, welding studs having integral connectors to the hull along a direction substantially fore and aft of the ship. Lines are supported and run relative to the studs. Sections of a shroud are connected to the lines and the lines are drawn to pull one end of the shroud sections proximal to the hull and the other end is fixed remote from the hull. Adjacent sections are secured along their sides. The entire space beneath the shroud and adjacent the hull containing the polluting materials is therefore separated from the environment.

30 Claims, 5 Drawing Sheets

WELDED STUD HANGING ASSEMBLY FOR A BLASTING AND COATING CONTAINMENT SYSTEM

BACKGROUND OF THE INVENTION

1. Field of the Invention

The present invention relates to method and apparatus for protecting the environment during the treatment of the hull surface of a ship. More particularly, the present invention relates to the containment of blasting dust and painting overspray and other materials used in treating the hull surface of a ship while supported in a dry dock.

2. Description of the Prior Art

For the treating of ship hull surfaces in an open environment such as in a dry dock, the activities must meet federal and state regulations and requirements addressed to maintaining clean air and clean water. In treating the hull surfaces, the activities usually include abrasive blasting to remove prior coatings and then spray painting. In both of these operations the materials used for the blasting and the spray painting or other coating escape to the environment in amounts that may cause irreparable damage.

The abrasive blasting necessarily produces a substantial amount of particulate material that must be contained to prevent the undesired pollution of the environment. In the past, the general practice to contain the blasting and coating operations in a dry dock was to hang tarpaulins or other sheeting material around the ship hull. But there never was a convenient point on or around the ship to secure the tarp. Further, any such attempt to extend the tarp around the ship proved extremely time consuming, often unreliable and potentially damaging to the surrounding structure or it was very complex in design and implementation. The operation was labor-intensive.

The present invention is considered to be a cost effective approach to resolving the problems of the prior art in that a secure environment is provided to contain materials from blasting or coating operations on ship hulls. Further, the blast and coating containment assembly and method of this invention is simpler and easier to erect and put into operation and also simpler and easier to dismantle at the end of the operation. When necessary, such as in a high wind, the entire assembly may be quickly taken down and then re-erected.

SUMMARY OF THE INVENTION

A containment method and apparatus is presented for protecting the environment from materials used in treating the hull surface of a ship in a dry dock. The method includes welding studs to the hull in a direction substantially fore to aft of the ship and then providing a plurality of lines that are supported by and running relative to the studs. The lead ends of at least one of these lines is secured to the head end of a section of shroud. The tail end of the shroud is secured to a fixed point remote from the ship. Drawing in on the line draws the head end of the shroud into proximal relationship with the hull surface forming a space between the hull and the shroud. Repeating the foregoing steps and joining the shroud sections together along their adjacent edges forms a protective shroud over the space along the hull of the ship. The coating and blasting operations occurring within this space are then secure so as to prevent release of the treating materials to the environment.

The containment assembly of the present invention includes a plurality of studs that may have heads or other connectors for welding to selected portions of the hull surface well above the deck of the dry dock or the ground. A plurality of lines are supported by and run relative to the studs and sections of shroud. One end of the line is secured to the head end of the shroud while the tail end of each length of the shroud is secured to a point remote from said ship so that upon drawing in on the lines the head end is drawn to a proximal relationship with the hull. Containment of the blast and coating materials is thereby achieved.

DETAILED DESCRIPTION

Figure 1:
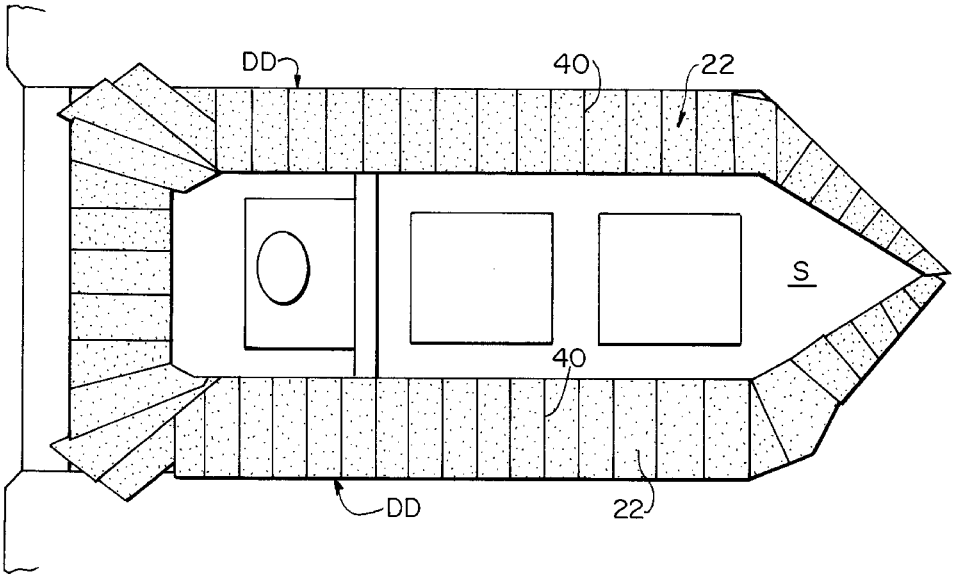
FIG. 1 is a plan view of the present invention illustrating a ship in dry dock and a plurality of shroud sections positioned to contain the space around the ship.
Figure 2:
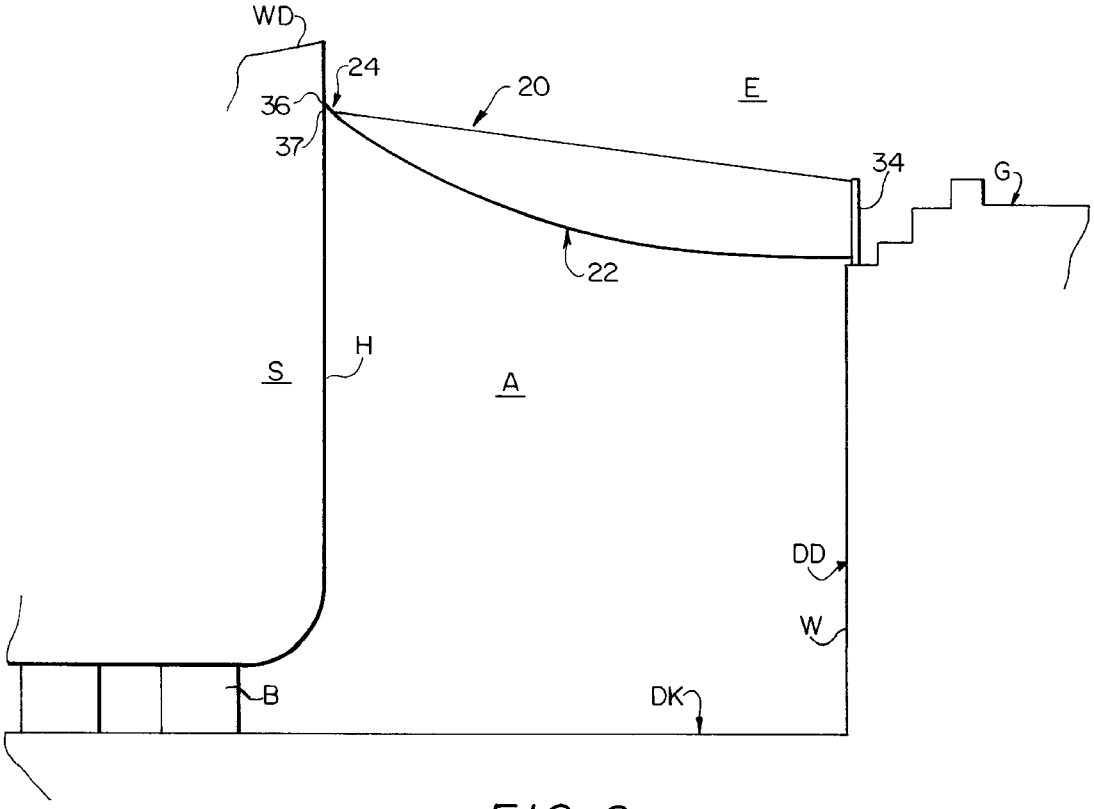
FIG. 2 is a schematic side elevational view, partly broken away, illustrating the space around the hull being contained by a shroud operated by pull cables or lines.

The overall view of the invention is best illustrated in FIGS. 1 and 2 where a ship S is positioned in a dry dock DD. The dry dock DD includes a wall W and a dry dock deck DK upon which the ship S is supported on suitable blocks B. The space to be contained and protected is shown at A and the environment is shown at E. The space A that is contained and confined is between the ship hull H, the dry dock deck DK and the dry dock wall W or ground G.

Figure 3A:
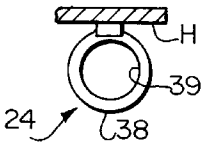
FIG. 3A is a view, partly broken away, taken along lines 3A—3A of FIG. 3 and illustrating the shape of the ring stud welded to the hull of the ship.
Figure 3:
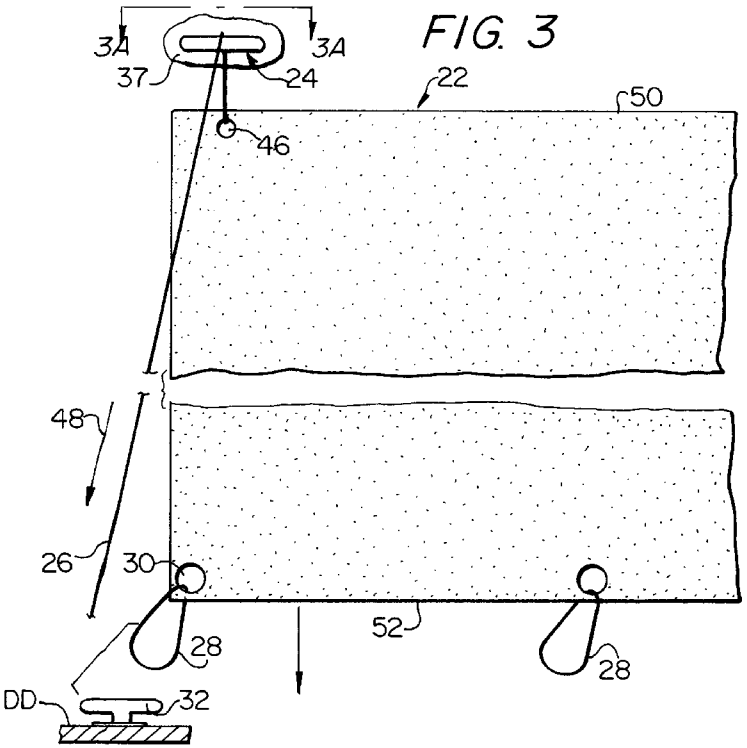
FIG. 3 is a plan view, partly broken away, of a shroud in place illustrating the line running through a ring stud and connected to one of the eyelets on one end of the shroud and an eyelet and a ring to a cleat on the dry dock at the other end of the shroud.

The containment assembly is shown generally at 20 and includes the shroud 22, studs 24 welded to the hull surface H as best shown in FIGS. 3 and 3A and lines 26 that are supported by and running through and relative to the studs 24. The assembly also includes the tie or rope 28 secured through eyelet 30 of the shroud 22 that is designed to be secured to a stay such as cleat 32, the pipe rail 34 or other fixed structure secured to the dry dock DD, as shown in FIGS. 2 and 3.

An important element of the present invention is the use of studs 24 welded to the ship surface at 36 to support the head end of shroud 22. The studs are placed generally along a line 37 in a direction substantially fore to aft and may be parallel to a deck of the ship such as the weather deck WD. Usually they would be adjacent to the weather deck, but could be at any level above the deck DK. The tail end of the shroud 22 is secured to fixed structure, as has been noted. With such a construction of the containment assembly 20 the entire space A between the ship S and the dry dock DD can be covered to protect the environment.

Figure 6:
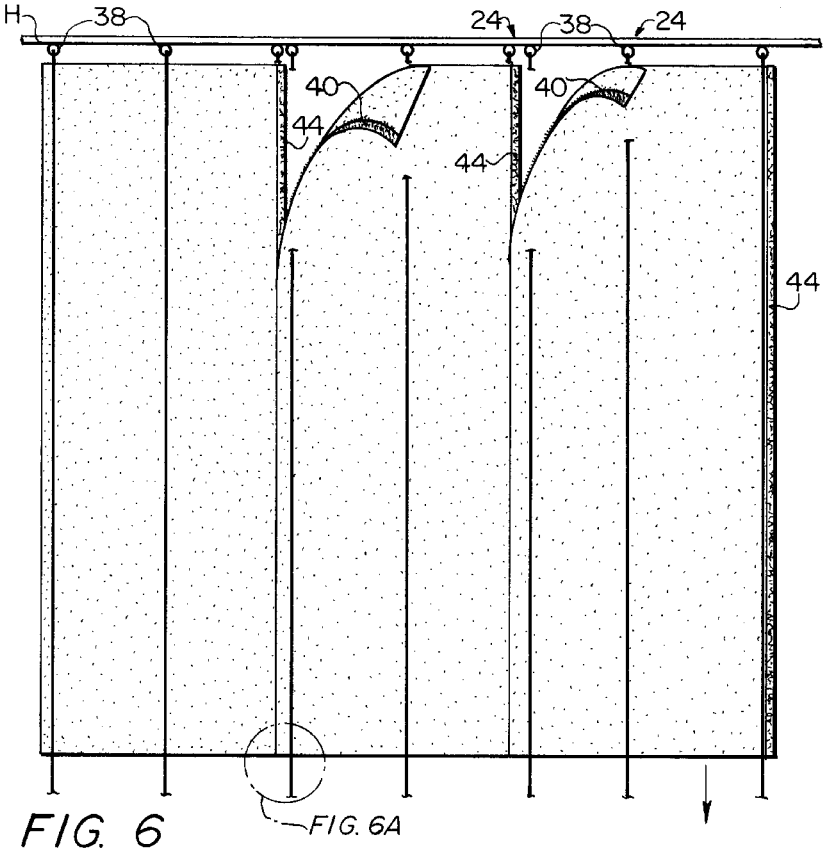
FIG. 6 is a plan view of the shroud in place and secured to ring studs welded along the hull surface and further illustrating the grippers in the form of Velcro® strips positioned along the sides of the sections of shroud to secure adjacent shroud sections together.
Figure 6A:
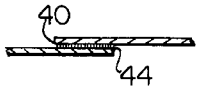
FIG. 6A is a cross-section of the joint between two sections of the shroud as shown at the circle 6A of FIG. 6.

The shroud 22, as shown in FIGS. 3 and 6 and 6A, is composed of fabric material that may be polyester, polypropylene or the like that is made in the form of sheet material or else tightly woven so that the particles of dust and paint spray to be contained are not permitted to escape. Preferably, the shroud is impervious to the paint spray and small dust particles that are generated during the blasting and coating operations.

As shown in FIGS. 3, 4, 5, and 9–16, the studs 24 may be in various forms, such as ring studs 38 or those studs shown in FIGS. 9–13 and are each provided with an integral connector. These studs may be welded along the top of the ship hull surface H generally along the fore to aft line 37 as shown in FIGS. 2, 3, 4 and 11. The shroud 22 is shown to be in sections for ease of handling. Attached to the sides 40 of the shroud are grippers 42 that may be in the form of Velcro® strips or tabs 44 having the conventional hook and eye complementary arrangements on mutually facing overlapping edges of the sides 40, 40 as best shown in FIGS. 1, 6 and 6A. Of course, any other means of securing the overlapping edges of sides 40 together could be used. It is possible that the adjacent sides 40, 40 could be threaded with a line through suitable eyelets (not shown) distributed along the sides 40, 40 or any other conventional attachment means could be used. However, the Velcro® strips are believed to be the preferable means due to the ease of attachment and separation that is inherent with Velcro®. For instance, the weight of the shroud sections as they drape downwardly in the center where they are unsupported as shown in FIG. 2 will mesh and temporarily lock the Velcro® strips to provide the desirable sealing between adjacent sections of the shroud.

In the simplest and therefore preferable form of the invention as shown in FIGS. 3 and 3A, the stud 24 is provided with a ring 39 and shot with a conventional stud gun (not shown) into the hull H of the ship. The worker using the stud gun moves along the ship's hull welding numerous studs to the hull surface generally along the fore to aft line 37 while another worker is running the line 26 through the ring 39 of the ring stud 38 and attaching the lead end of the line to shroud head end eyelet 46. The stud welding operation may be carried out from the weather deck of the ship without special staging or equipment. Alternatively, the studs may be installed from staging (not shown) or from a personnel lift (not shown), and can be applied at any level desired, not just at the deck level shown. The section of shroud 22 is installed by pulling on line 26 in the direction of arrow 48 to pull the leading edge 50 of the head end 51 of the shroud 22 closely adjacent the hull H as best shown in FIG. 2. The tail end 52 of the shroud 22 is provided with the eyelet 30 as previously stated through which is looped the tie 28 in the form of a rope or other length of line that is secured to the cleat 32 or the pipe rail 34 or any other convenient tie point on the surface of the dry dock DD or ground G. Repeating this procedure with a plurality of sections of shroud produces the containment of space A around the periphery of the ship S as shown in FIGS. 1 and 2.

Figure 5:
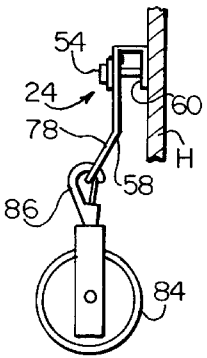
FIG. 5 is a view, partly broken away, taken along lines 5—5 of FIG. 4 and illustrating the headed stud, hanger, and sheave secured to the hull of the ship.
Figure 4:
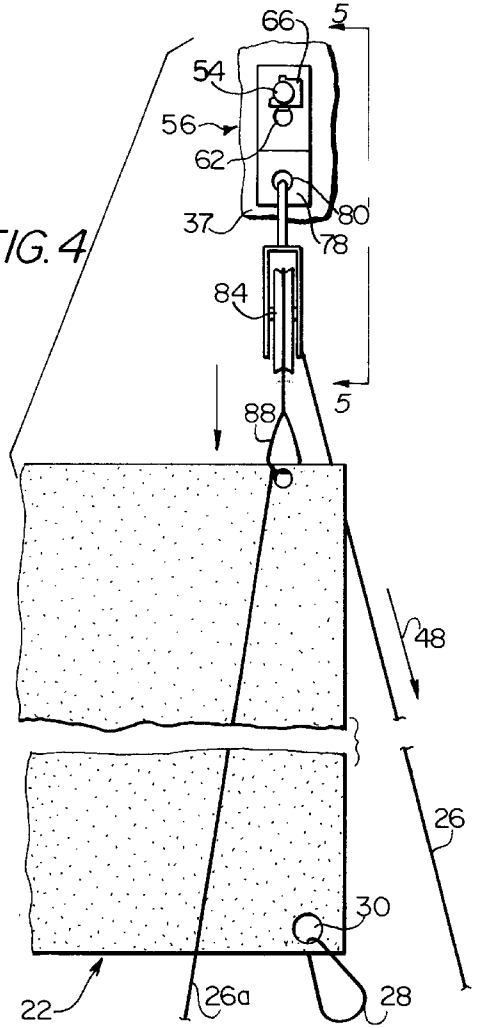
FIG. 4 is a plan view, partly broken away, of a shroud secured to the hull of the ship with a headed stud, a hanger with retainer, and a sheave secured to the hanger through which a line runs to hold the head end of the shroud to the hull of the ship.
Figure 18:
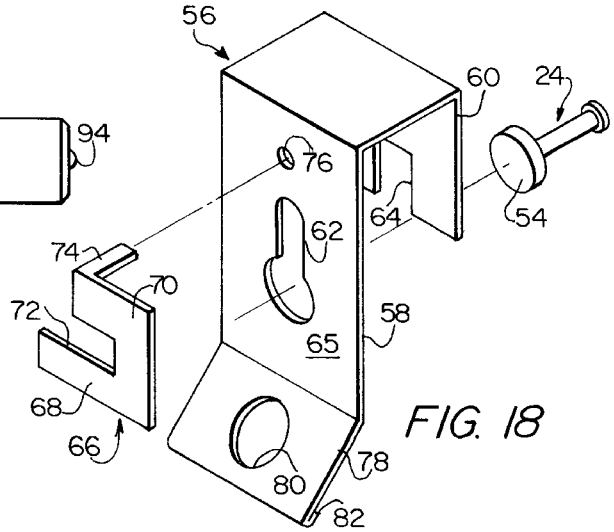
FIG. 18 is an exploded perspective view of the hanger, the stud with integral head and the retainer for securing the hanger to the stud.
Figure 19:
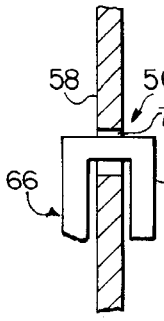
FIG. 19 is an enlarged cross-sectional view, partly broken away, of the retainer having a tab bent behind the hanger to hold it in place.

An alternative arrangement for the containment assembly 20 is shown in FIGS. 4, 5 and particularly 18 wherein the stud 24 welded to the hull H is provided with a head 54 that forms an integral connector for the support of hanger 56. This hanger 56 is in the form of a U-shaped strap with one leg 58 longer than the other leg 60. At the upper end of the hanger 56 in the form shown in FIGS. 4, 5 and 18 is a key slot 62 formed into the longer leg 58. A U-shaped slot 64 is formed in the shorter leg 60 to register with key slot 62. Stud 24 is designed to pass through slot 64 and key slot 62 so that head 54 rests on face 65 of hanger 56. To secure the hanger 56 to the welded stud 24, retainer 66, of unique design, is coupled to the stud 24 and the hanger 56.

As best illustrated in FIGS. 4, 5, 18 and 19, the retainer clip 66 is essentially U-shaped in its principal plane with coplaner long leg 68 and short leg 70 forming the U-shaped slot 72. Protruding transversely to the plane of the legs 68 and 70 is a short tab or prong 74 that is designed to be received into hole 76 in order to retain the hanger 56 securely to the welded stud 24.

Figure 8:
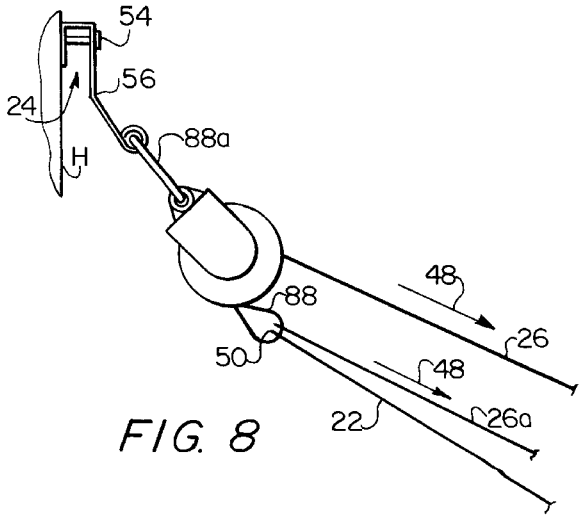
FIG. 8 is a side elevational view, partly broken away, illustrating a stud having a head and a hanger along with the pulley secured to the hanger through which a rope or a line is for running the line and also illustrating an additional line secured to the loop end of the reeved line to take down the shroud from its erected position.

Hanger 56 is also provided with an offset leg 78, best shown in FIGS. 4, 5 and 18, into which an opening 80 is formed. The lowest edge 82 of the offset leg 78 may be turned in as shown in FIG. 18 for greater strength. The opening 80 may receive and support a sheave 84 through the connection of a conventional snap hook 86 or D-ring 88*a,* as shown in FIGS. 5 and 8 respectively. Line 26 may be reeved around the pulley 84 for running therethrough. The lead end of the line 26 may be formed into a loop 88 or have secured thereto a D-ring 88*a* that may be suitably secured to the head end of the shroud 22. As previously stated, the line 26 when pulled in the direction of the arrow 48 pulls the head end 50 of the shroud up to the hull surface. Again, tie 28 may be suitably secured to any fixed structure on the dry dock DD or at ground level G in the form of cleat 32, pipe rail 34 or any other fixed stay.

Figure 7:
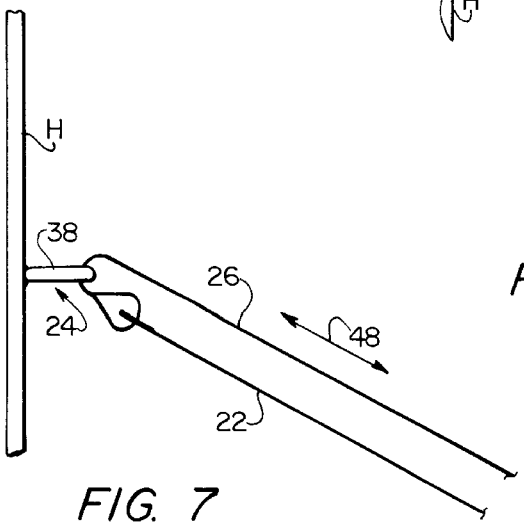
FIG. 7 is a side elevational view, partly broken away, illustrating the positioning and securing of the shroud to the ring stud welded to the ship's structure and the line running through the loop of the ring stud that draws the shroud to the hull surface.

The embodiments of FIGS. 4 and 8, as distinguished from the embodiments of the invention disclosed in FIGS. 3 and 7, for instance, show dual lines 26 and 26*a*. It is obvious that the use of dual lines 26 and 26*a*permit the drawing up and taking down of the shroud in a positive direct and forceful manner. The retrieving line 26*a* is attached to the D-ring 88*a* that is also secured to the head end of the shroud 22. As shown in FIG. 8, instead of the snap hook 86, D-ring 88*a* may be used to secure sheave 84 to hanger 56.

Figure 9:
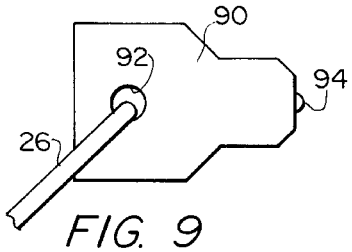
FIG. 9 is a side elevational view, partly broken away, of a flat bar stud for welding to the ship and a line.
Figure 9A:
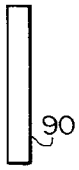
FIG. 9A is an end elevational view of the flat bar stud only.
Figure 10:
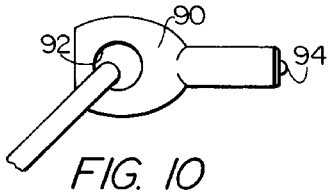
FIG. 10 is a side elevational view, partly broken away, of a stud with a flattened end for receiving a line.
Figure 10A:
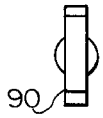
FIG. 10A is an end elevational view of the stud of FIG. 10.
Figure 11:
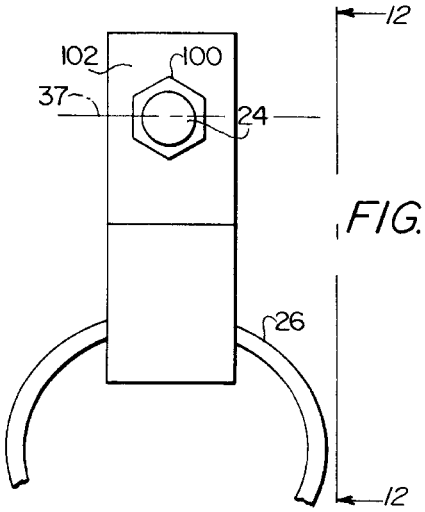
FIG. 11 is a front elevational view, partly broken away, of a threaded stud with a nut retaining a hanger in the form of a strap, and a line held by the hanger.
Figure 12:
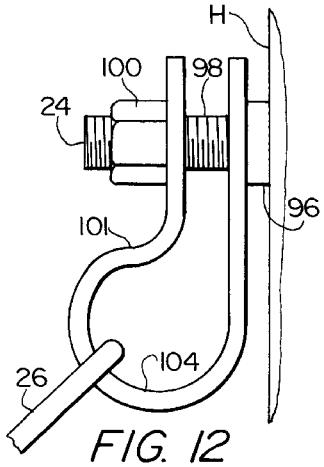
FIG. 12 is a side elevational view, partly broken away, of the stud and strap of FIG. 11 taken along lines 12—12 and illustrating the modified U-shape of the strap.
Figure 13:
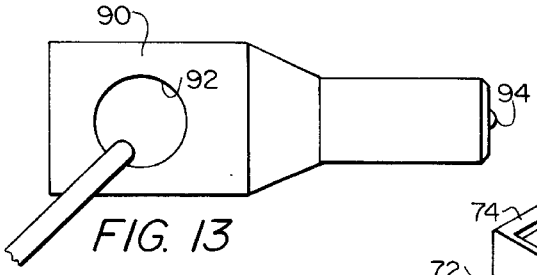
FIG. 13 is a side elevational view, partly broken away, of yet another stud having a square end and a hole for receiving the line.

FIGS. 9 through 13 disclose a variety of different types of studs that may be used with this invention. Essentially all of the studs are provided with some form of integral connector that allows the securing and running of lines 26. In FIG. 9 there is disclosed a flat bar stud 90 from which line 26 extends through suitable opening 92 so that the line may run free. Conventional flux 94 is positioned at the opposite end as required for welding the stud. In FIG. 10, there is shown a stud like that of FIG. 9 but with a round welded end. In a similar fashion, the stud of FIG. 13 is like those of FIGS. 9 and 10. FIGS. 11 and 12 show a different form of stud 24 that is provided with a flat abutting end 96 for being welded to the hull surface H. The stud 24 in this instance is also provided with a threaded shank 98 and a nut 100 in order to secure a U-shaped strap 101 forming tubular shaped opening 104 for running line 26 directly or using sheave 84 and D-ring 88, snap hook 86, or the like.

Figure 16:
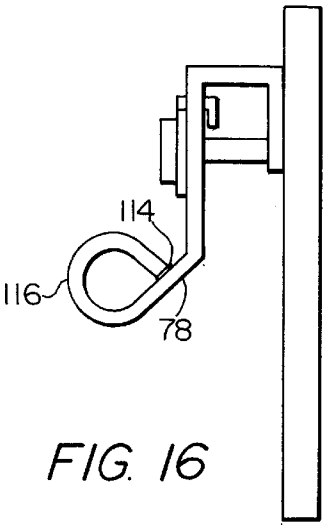
FIG. 16 is a side elevational view partly broken away and in cross-section taken along lines 16—16 of FIG. 14.
Figure 15:
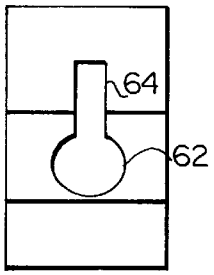
FIG. 15 is a back view of the line hanger of FIG. 14 without the stud or retainer.
Figure 14:
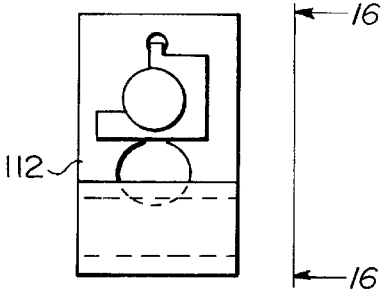
FIG. 14 is a front elevational view of a line hanger held by a retainer to a welded stud having a head.

FIGS. 14, 15, 16 and 17 depict a modification of the present invention in that the studs 24 are installed as previously described but between the forwardmost stud 24*f* and aftmost stud 24*t* there is stretched a cable 106. This cable is provided with loops 108 at each end with which to fasten it to hangers 112, 112 that are similar to hanger 56 of FIG. 4 but each a loop 116 as shown in FIG. 16, instead of hole 80.

Figure 17:
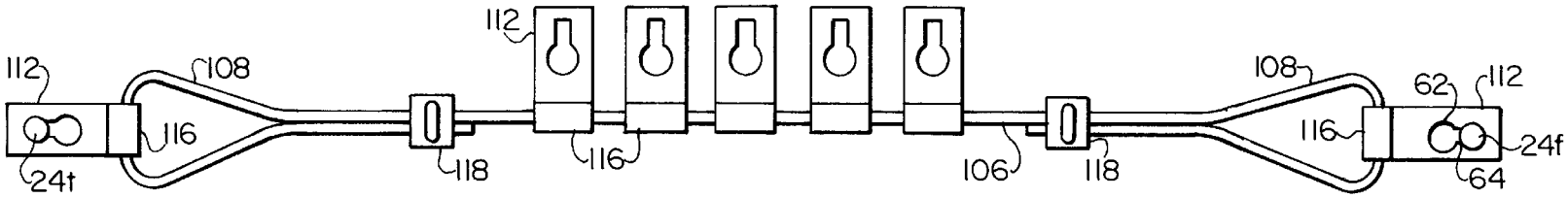
FIG. 17 is a side elevational view of an alternate embodiment illustrating the use of a cable stretched along the side of the ship and having end ties secured to studs welded to the ship and hangers for securing the cable to welded studs on the surface of the ship.

Each loop 116 of each hanger 112 receives the cable 106 as best shown in FIG. 17. The hangers 112 have the same key slot 62 and U-slot 64 as previously discussed. Each of the hangers 112 supporting the cable 106 is supported by the plurality of welded studs positioned between studs 24*t* and 24*f*. Cable clamps 118 retain loops 108. With the positioning of the cable, lines 26 (not shown) are supported by and capable of running relative to the cable to raise and lower the shroud as previously discussed.

After the blasting and coating operations have ceased, the shroud may be taken down. The studs are then simply ground off. This additional step of grinding incurs a minor additional cost of little consequence given the ease of forming the contained space A and the security that it provides for the environment. Furthermore, the studs may be left in place for later use for the same or similar purposes if desired.

One of the advantages of the assembly of the present invention is that access of cranes to the dry dock is facilitated even after installation of the containment assembly. This can be accomplished simply by taking down one section of shroud, then raising it again once the crane load is placed on the dry dock deck DK. Another advantage of the present assembly is that all shrouds can be taken down quickly in the event of high winds to prevent damage to the shroud or to the ship and dry dock equipment or personnel.

It should be noted that this invention may be practiced in other places than a dry dock. For example, the ship could be sitting on land. The tail end of the shroud could then be fastened to any fixed point spaced from the hull of the ship, including the ground G. It may also be used on a section of the hull rather than the entire periphery. In this case the vertical edges of the end sections could be fastened to the ship using the stud method described herein. Its use is also not restricted to ships. It could be used on any other metal structure, such as a storage tank.

It is believed that all of the advantages of the present invention are apparent and the invention should be limited solely by the appended claims in which

We claim:

1. A method for containment of a space adjacent the hull of a ship to protect the environment from pollutants resulting from treatment of said hull comprising:

welding studs to the hull along a direction substantially fore to aft of the ship;

providing at least one line having a lead end and a back end;

providing a first section of shroud having a head end and a tail end;

securing the lead end of at least one of said lines to the head end of said shroud section;

securing the tail end of said shroud section to a fixed point remote from said ship;

supporting each line by and running said each line relative to said studs;

drawing in on at least one of said lines to pull the head end of said shroud section proximal to said hull to form said space between said shroud and said hull;

repeating these steps to enclose said space between the shroud and the hull of the ship and protect said environment from said space.

2. The process of claim 1 including, providing at least one of said studs with an integral connector;

running one of said lines through said connector.

3. The process of claim 2 including, providing said integral connector of said stud with a loop and running one of said lines through said loop.

4. The process of claim 1 including, setting the ship in a dry dock having a deck;

providing at least one stay on said dry dock spaced from said ship and elevated above the deck of the dry dock;

securing said tail end of said shroud to said stay.

5. The process of claim 1 including, providing grippers along the sides of said shroud sections for mating with and securing adjacent overlapping sides of said shroud sections.

6. The process of claim 1 including, providing a sheave connected to at least one of said studs; and running one of said lines around said sheave.

7. The process of claim 1 including, providing a cable of substantial length relative to said ship;

securing said cable to said studs; and running and supporting one of said lines relative to said cable.

8. The process of claim 1 including, setting the ship on the deck of a dry dock;

providing at least one of said studs with an integral, connector;

running one of said lines relative to said connector;

providing at least one stay on said dry dock spaced from said ship and elevated above said deck;

securing said tail end of said shroud to said stay.

9. The process of claim 1 including, setting the ship on the deck of a dry dock;

providing at least one of said studs with an integral connector;

running one of said lines relative to said connector;

providing at least one stay on said dry dock spaced from said ship and elevated above said deck;

securing said tail end of said shroud to said stay;

providing grippers along the sides of said shroud section for mating with and securing an overlapping side of said shroud section with the side of an adjacent shroud section.

10. The process of claim 1 including, providing at least one of said studs with an integral connector;

providing a sheave connected to at least one of said studs;

running said line around said sheave.

11. An assembly for containing a space adjacent the hull of a ship and for protecting the environment from materials used in treating the hull of said ship supported on the deck and between the side walls of a dry dock comprising:

studs for welding to selected portions of the hull above said deck;

weldments securing said studs to said hull;

a plurality of lines supported by and running relative to said studs, each line having a lead end and a back end;

a plurality of sections of shroud, each section having a head end and a tail end;

one end of at least one line selected from said lines being secured proximate to said hull and to the head end of said shroud section;

said tail end of each section of said shroud being secured to a fixed point forming a stay position remote from said ship;

whereby upon drawing in on at least one of said lines and drawing said head ends into proximal relationship with said hull surface said space is formed for containment of said materials from said environment.

12. The assembly of claim 11 including, said studs having integral connectors for receiving and running said lines.

13. The assembly of claim 12 including, at least one of said integral connectors having a loop for receiving and running said lines.

14. The assembly of claim 11 including, at least one stay position located on said dry dock spaced from said ship and elevated above said deck for fixing the tail end of said shroud.

15. The assembly of claim 11 including, a plurality of grippers positioned along sides of said shroud sections for mating with and securing overlapping sides of said shroud sections with the sides of adjacent shroud sections.

16. The assembly of claim 11 including, a sheave connected to at least one of said studs for receiving and running one of said lines.

17. The assembly of claim 11 including, said studs each having a head and at least one generally U-shaped hanger supported by one of said studs and receiving said head therethrough.

18. The assembly of claim 17 including, a retainer received by the head of said stud and said hanger and having a tab projecting through said hanger to secure said hanger to said stud.

19. The assembly of claim 18 including, said tab projecting through said hanger and extending transversely to said stud on the side of said hanger remote from said head.

20. The assembly of claim 17 including, said hanger having slots in both legs to receive said head of said stud and at the other end thereof an opening.

21. The assembly of claim 20 including, a sheave secured to said opening for receiving and running one of said lines.

22. The assembly of claim 11 including, said studs having integral connectors for receiving and running said lines; and at least one stay position located on said dry dock spaced from said ship and elevated above said deck for fixing the tail end of said shroud.

23. The assembly of claim 11 including, said studs having integral connectors;

said integral connectors each having a loop for receiving and running at least one of said lines.

24. The assembly of claim 11 including, said studs having integral connectors;

said integral connectors having a loop for receiving and running at least one of said lines; and a plurality of grippers positioned along sides of said shroud sections for mating with and securing overlapping sides of said shroud sections with the sides of adjacent shroud sections.

25. The assembly of claim 11 including, said studs having an integral connector;

said integral connector having a loop for receiving and running at least one of said lines;

a plurality of grippers positioned along sides of said shroud for mating with and securing overlapping sides of said shroud with an adjacent side of said shroud; and a sheave connected to at least one of said studs for receiving and running one of said lines.

26. The assembly of claim 11 including, said studs having an integral connector;

said integral connector having a loop for receiving and running at least one of said lines; and a plurality of grippers positioned along sides of said shroud for mating with and securing overlapping sides of said shroud with an adjacent side of said shroud.

27. The assembly of claim 11 including, said studs having an integral connector;

said integral connectors having a loop for receiving and running at least one of said lines;

a plurality of grippers positioned along sides of said shroud for mating with and securing overlapping sides of said shroud with an adjacent side of said shroud;

a sheave connected to at least one of said studs for receiving and running one of said lines;

said studs having heads;

at least one hanger supported by one of said studs and receiving said head therethrough;

a retainer received by the head of said stud and said hanger and having a tab projecting through said hanger to secure said hanger to said stud; and said tab projecting through said hanger and extending transversely to said stud on the side of said hanger remote from said head.

28. The assembly of claim 11 including, a cable extending along a direction substantially fore to aft of the ship;

each end of said cable being secured to one of said studs;

a plurality of hangers secured to said cable intermediate said ends;

each of said hangers having a slot remote from said cable for receiving studs and supporting said hangers and said cable, and said lines running over said cable to be supported thereon.

29. The assembly of claim 28 including, said hangers having a tubular end portion for receiving said cable.

30. The assembly of claim 29 including, said studs each having a head remote from said ship; and a retainer being received by the head of said stud and said hanger and having a tab projecting through said hanger to secure said hanger to said stud.

* * * * *